US008296973B2

(12) United States Patent
Roberti

(10) Patent No.: US 8,296,973 B2
(45) Date of Patent: Oct. 30, 2012

(54) MULTI-FUNCTIONAL FOOTWEAR

(75) Inventor: Nathanael B. Roberti, Lakeside, CA (US)

(73) Assignee: Deckers Outdoor Corporation, Goleta, CA (US)

( * ) Notice: Subject to any disclaimer, the term of this patent is extended or adjusted under 35 U.S.C. 154(b) by 663 days.

(21) Appl. No.: 12/404,928

(22) Filed: Mar. 16, 2009

(65) Prior Publication Data

US 2010/0229424 A1 Sep. 16, 2010

(51) Int. Cl.
*A43B 5/00* (2006.01)

(52) U.S. Cl. ..... 36/113; 36/114; 36/132; 36/136

(58) Field of Classification Search ..... 36/3 R, 36/3 B, 113, 116, 114, 103, 132, 136, 107, 36/108, 72 A, 73, 75 R
See application file for complete search history.

(56) References Cited

U.S. PATENT DOCUMENTS

| | | | | | |
|---|---|---|---|---|---|
| 398,453 | A | * | 2/1889 | Schnarr | 36/72 R |
| 881,079 | A | * | 3/1908 | Jolitz | 36/72 R |
| 890,388 | A | * | 6/1908 | Wilcox | 36/72 A |
| 1,051,880 | A | * | 2/1913 | Glenn | 36/72 R |
| 1,152,185 | A | * | 8/1915 | Koch | 36/72 R |
| 1,685,538 | A | * | 9/1928 | Glidden et al. | 36/30 R |
| 1,704,187 | A | * | 3/1929 | Glidden et al. | 36/32 R |
| 2,045,066 | A | * | 6/1936 | Bower | 36/59 R |
| 2,229,387 | A | * | 1/1941 | Parker | 36/4 |
| 4,005,533 | A | * | 2/1977 | Anderson et al. | 36/62 |
| 4,198,771 | A | * | 4/1980 | Foster | 36/136 |
| 4,524,530 | A | * | 6/1985 | Greenway | 36/113 |
| 4,596,387 | A | * | 6/1986 | Roberts | 482/139 |
| 4,716,663 | A | * | 1/1988 | Steinhauser | 36/113 |
| 4,910,887 | A | * | 3/1990 | Turner et al. | 36/114 |
| 4,912,858 | A | * | 4/1990 | Mochizuki | 36/3 B |
| 4,939,851 | A | * | 7/1990 | Miller | 36/3 B |
| 5,003,709 | A | * | 4/1991 | Okayasu et al. | 36/107 |
| 5,033,209 | A | * | 7/1991 | Bathurst et al. | 36/7.3 |
| 5,134,791 | A | * | 8/1992 | Gregory | 36/107 |
| 5,179,792 | A | | 1/1993 | Brantingham | |
| 5,410,821 | A | * | 5/1995 | Hilgendorf | 36/100 |
| 5,513,449 | A | * | 5/1996 | Gramola | 36/114 |

(Continued)

FOREIGN PATENT DOCUMENTS

| | | |
|---|---|---|
| JP | 2001-137002 | 5/2001 |

(Continued)

OTHER PUBLICATIONS

International Search Report dated Oct. 19, 2010 for PCT/US2010/026360.

*Primary Examiner* — Marie Patterson
(74) *Attorney, Agent, or Firm* — Greer Burns & Crain, Ltd.

(57) ABSTRACT

Described are embodiments of multi-functional footwear. In one example, an article of footwear includes a climbing arch configured to receive at least a portion of a climbing surface. The climbing arch also includes a plurality of engagement members extending from the arch and configured to engage a climbing surface. The article of footwear may also include a protective plate, a plurality of outwardly extending protrusions that form a receiving area configured to receive a portion of a second body, a drainage system configured to drain liquid from within the article of footwear, and/or an anti-rope burn upper. The described, multi-functional footwear may be designed with significantly less mass than known footwear.

22 Claims, 9 Drawing Sheets

U.S. PATENT DOCUMENTS

| | | | | |
|---|---|---|---|---|
| 5,918,385 | A * | 7/1999 | Sessa | 36/59 C |
| 6,115,946 | A * | 9/2000 | Morris et al. | 36/115 |
| 6,182,377 | B1 * | 2/2001 | Toensing | 36/8.1 |
| 6,360,456 | B2 * | 3/2002 | Davis et al. | 36/138 |
| 6,408,540 | B1 * | 6/2002 | DeKalb et al. | 36/8.1 |
| 7,159,336 | B2 * | 1/2007 | Burns et al. | 36/8.1 |
| 7,685,747 | B1 * | 3/2010 | Gasparovic et al. | 36/102 |
| 7,913,427 | B2 * | 3/2011 | Edwards et al. | 36/131 |
| 2003/0196354 | A1 * | 10/2003 | Chu | 36/113 |
| 2006/0162193 | A1 * | 7/2006 | Jones et al. | 36/136 |
| 2006/0277785 | A1 | 12/2006 | Vattes et al. | |
| 2007/0068047 | A1 * | 3/2007 | Alfaro et al. | 36/136 |
| 2007/0283596 | A1 * | 12/2007 | Park | 36/62 |
| 2008/0263903 | A1 * | 10/2008 | An | 36/134 |

FOREIGN PATENT DOCUMENTS

| | | |
|---|---|---|
| KR | 20-0381786 | 4/2005 |

* cited by examiner

MULTI-FUNCTIONAL FOOTWEAR

BACKGROUND

1. Field

The invention relates generally to the field of footwear. Specifically, the invention concerns footwear designed to meet certain operational and environmental situations commonly occurring in military, outdoor, recreation, and related settings.

2. Description of the Related Art

It is known that soldiers, various military personnel, law enforcement professionals, hunters, fishermen, hikers, climbers, and various other outdoor enthusiasts encounter various environments during the course of outings, exercises, trainings, and field operations.

Typical environments and operational situations include: sharp objects capable of piercing through footwear and on into a foot; complex obstacles that need to be negotiated; rope, ladder, and other ascent and descent situations, fast roping, repelling, bouldering, climbing, free-falling, diving, assaults, clandestine approaches, and the like. Such activities may also include the need to negotiate damp terrain, rivers, swamps, and other bodies of water where swimming is required.

Existing footwear often tend to slip during the act of climbing because of thick rubber outsoles that limit agility due to their thickness. Additionally, existing rubber surface outsoles are not concave and/or designed for climbing. The existing footwear in the art suffer from slippages, heavy mass (particularly when wet). Use of such footwear may result in increased climbing time. These shortcomings result in the need for significant supplementation of leg-driven climbing techniques through various compensatory efforts, including arm and hand efforts, often causing upper body fatigue. Additionally, existing footwear often do not properly fit into commonly encountered footholds during climbing. For example, existing footwear are too large to fit into the rungs commonly encountered on ladders and other fixtures associated with military ships. These deficiencies may force soldiers to partially, or in some cases even, totally abandon the use of the feet and legs for climbing locomotion. Furthermore, existing footwear provide no design features which address the frictional forces encountered during, for example, rope ascents and descents. Accordingly, users routinely suffer frictional burns and resultant blistering due to the forces encountered during such ascents and descents. Additionally, it is common for military personnel, law enforcement personnel, and outdoor enthusiasts to engage in rappelling and other rope maneuvers where frictional forces created by the contact ropes, and similar surfaces, with footwear lead to damage to the footwear and user.

Existing footwear are comprised of a thick rubber, or similar material, outsole designed to provide protection for the foot from the breach of the outsole. However, existing outsoles commonly fail to protect the foot from sharp objects found in various settings. Many objects encountered are capable of cutting through even the thickest of rubber outsoles and, accordingly, existing footwear often fail to protect a user's foot from penetration injuries. Also, existing footwear may retain liquid in the uppers for long periods of time resulting in blistering of the foot, unwanted noise production, and the accumulations of unwanted weight.

Additionally, existing footwear do not properly fit into swimming fins that are used in multiple aquatic applications and environments. Also, existing footwear do not provide a mechanism to ensure the coupling of a swimming fin to an article of footwear in a footwear-in-swimming fin application. Thus, existing footwear often dislodge from swimming fins, resulting in lost swimming fins and impaired swimming locomotion. Existing footwear also do not provide design features that address the need for military personnel, hunters, fisherman, archers, etc. to have footwear that produces very little sound upon locomotion.

Certain military personnel often require footwear that can function while a wearer is engaging in "hooking and climbing," and often require footwear suited to moving safely throughout the exteriors and interiors of a ship or related vessel. Wearers thus need footwear that allows proper entry and exit from climbing rungs, as well as footwear with a climbing arch and other features. For operations and exercises that require diving and swimming, soldiers need footwear that can fit into swim fins. Combination footwear able to meet the above needs would provide a wearer with the ability to execute a number of varied operations and exercises without the need to change or remove footwear. For example, a multi-functional footwear is needed that could allow a wearer to exit an aircraft into water, swim toward a target, and move over land to a target or operational theater, all without having to remove the footwear.

Common military footwear has undergone little change over the last 30 years. Therefore, standard issue footwear has not been designed to meet the specific environmental and operational situations mentioned above. Additionally, fatigue is a major operational hazard encountered during military, and related, operations, and currently used footwear invariably consists of materials and design features that create an unnecessarily heavy unit of footwear, directly adding to the fatigue of a user. Many of the military-related environmental situations and challenges that are mentioned above also relate to situations encountered during various civilian outdoor pursuits. For example, footwear that could be used both in and out of water would be useful for hunters, fishermen, kayakers, rafters, hikers, and other outdoorsmen. Footwear that could be used for walking, while being sufficiently streamlined to fit into a swim fin, would be especially useful for float tube fishermen. Footwear that could dry quickly after being used in wet environments such as those encountered in rafting, kayaking, fishing, and hunting are also needed. Footwear that could obviate the need for two (or more) separate types of footwear in a given outing would be advantageous. Footwear that could lessen the noise produced during locomotion would be advantageous, as would footwear that could decrease the oscillation generated with locomotion would be advantageous to hunters, shooters, archers, paint ball enthusiasts, and the like.

In view of the foregoing, there is a need for new version of footwear that overcomes deficiencies of current footwear, including, but not limited to, deficiencies found in conventional footwear intended for exercise, training, mechanical, combat and security driving, direct action missions, hostage rescue, law enforcement, air and land-based assaults, insertions, desertions, urban warfare, mountain warfare, land navigation, combat jumping, high altitude low opening, and high altitude high opening combat and training, over-the-beach missions, breaching, close-quarters combat, hunting, fishing, climbing, hiking, repelling, rafting, kayaking, archery, paint ball games, other outdoor pursuits, and various other military and civilian uses.

SUMMARY

According to a first aspect, embodiments disclosed herein comprise an article of footwear comprising a sole and an upper secured to the sole, the article of footwear comprising a toe area and a heel area, the upper comprising a distal surface and a proximal surface, the sole comprising a midsole secure to the upper, the midsole having a first surface and a second surface, the first surface being disposed between the upper and the second surface, an outsole coupled with the second surface, the outsole having a bottom surface and a top surface, the top surface being disposed between the upper and the bottom surface, the outsole comprising a climbing arch disposed at least partially on the bottom surface, the climbing arch disposed at least partially on the bottom surface, the climbing arch being configured to receive at least a portion of a climbing surface and a plurality of engagement member extending outwardly from the climbing arch in a distal direction, the engagement members being configured to engage a climbing surface, a protective plate disposed at least partially between the upper and the bottom surface, the protective plate comprising a material that is harder than the midsole and the outsole, a plurality of outwardly extending protrusions extending from the upper, at least one protrusion extending from the heel area, the plurality of outwardly extending protrusions forming a receiving area configured to receive at least a portion of a second body, and a drainage system disposed at least partially between the first surface and the bottom surface, the drainage system being configured to drain liquid from within the article of footwear.

According to a second aspect, embodiments disclosed herein comprise an article of footwear comprising a sole and an upper secured to the sole, the upper comprising a distal surface and a proximal surface, the sole comprising a top surface, a bottom surface disposed such that the top surface is between at least a portion of the upper and the bottom surface, a protective plate disposed at least partially between the top surface and the bottom surface, and a drainage system disposed at least partially between the top surface and the bottom surface, the drainage system being configured to drain liquid from within the article of footwear.

According to a third aspect, embodiments disclosed herein comprise an article of footwear comprising a sole and an upper secured to the sole, the sole including a bottom surface, the upper comprising a distal surface and a proximal surface, the sole comprising a protective plate configured to protect the foot of a user, the protective plate disposed at least partially between the bottom surface and the upper, and a climbing arch disposed at least partially on the bottom surface, the climbing arch being configured to receive at least a portion of a climbing surface and comprising a plurality of engagement members extending from the climbing arch, the engagement members being configured to engage a climbing surface.

Further aspects and features of the present invention will be apparent to persons of ordinary skill in the art, based upon the description provided herein.

BRIEF DESCRIPTION OF THE DRAWINGS

Example embodiments disclosed herein are illustrated in the accompanying schematic drawings, which are for illustrative purposes only. The drawings are not drawn to scale, unless otherwise stated as such, or necessarily reflect relative sizes of illustrated aspects of the embodiments.

DETAILED DESCRIPTION OF PREFERRED EMBODIMENTS

Embodiments are described with reference to FIGS. 1A-4D, wherein like numerals refer to like elements throughout. The terminology used in this description is not intended to be interpreted in any limited or restrictive manner; it is being utilized for illustrative purposes in conjunction with a detailed description of certain embodiments. Furthermore, embodiments may include several novel features, and no single feature is solely responsible for its desirable attributes or is essential to practicing the embodiments herein described.

Multi-functional footwear is described by providing design features that address certain needs encountered in military, law enforcement, outdoor pursuits, and related situations. In a preferred embodiment, multi-functional footwear includes: an outsole configured to prevent puncture and breach into and through the outsole material; a last configured to transfer a portion of downward momentum generated during locomotion to forward momentum in order to decrease the fatigue of a user; an upper including a physically supplemented region designed to reduce the amount of frictional forces passed to a user's foot during rope ascents, descents, and similar activities; an outsole with a shaped indention region made with adhesion-promoting material to facilitate climbing and similar activities; a one-way valve system configured to extract collected liquids from within the foot housing section of the footwear; a narrow width profile to allow for entry of the footwear into common footholds, swimming fins, and similar structures; a heel containing raised protrusions and engagement features configured to engage the strap portion of a swimming fin in order to secure the strap to the footwear; and a clipping loop on the footwear upper configured to attach a leash or similar fastener from a swimming fin to the footwear to couple the footwear to the swimming fin. In some embodiments, multi-functional footwear may be designed to minimize the amount of noise produced by the footwear during locomotion and decrease oscillation characteristics. In some embodiments, multi-functional footwear may be designed with significantly less mass than footwear known in the art.

Figure 1A:
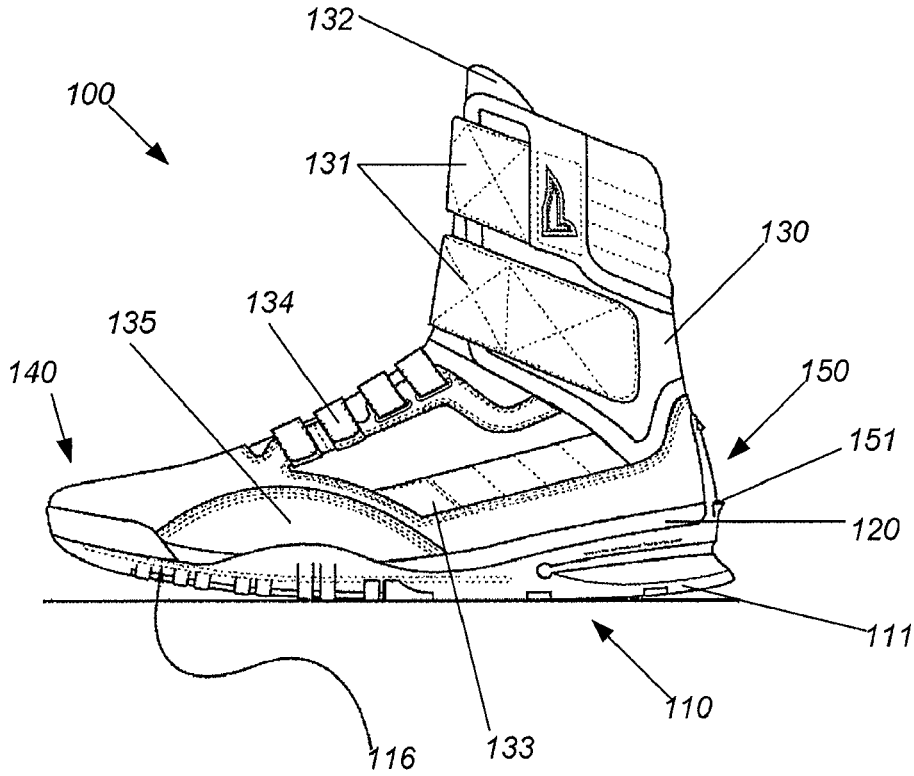
FIG. 1A schematically illustrates a left side view of an article of multi-functional footwear in accordance with a preferred embodiment of the present invention.

Turning now to FIG. 1A, a left side view of an embodiment of multi-functional footwear 100 is shown. The article of footwear 100 may be used in many different environments including combat, hunting, hiking, rafting, swimming, security, law enforcement, and other outdoor activities. The article of footwear 100 shown is configured to be worn on the left foot of a user. The article of footwear 100 includes a sole 110 on the bottom of the article of footwear and an upper 130 that is configured to hold the article of footwear onto the foot of a user. The sole 110 includes an outsole 111 that directly contacts the ground or walking surface, an insole (not shown) that directly supports the bottom of a user's foot, a midsole 120 that is disposed at least partially between the outsole and the insole. The front of the article of footwear 100 includes a toe box 140 and the back of the article of footwear includes a heel portion 150.

Still referring to FIG. 1A, the upper 130 may comprise microfiber and/or waterproof/water shedding synthetic leather or a similar material. For example, the upper may comprise synthetic leather. In some embodiments, the inner portion of the upper 130 includes a moisture wicking, water shedding, antimicrobial lining (not shown) which may comprise the same material as the outer portion of the upper 130 or may comprise a different material. The lining of the upper 130 may comprise a synthetic fabric or other synthetic material including water proof and water resistant materials. The lining may be attached to the article of footwear 100 using common methods, for example, stitch and turn methods, and can be loose-lined in order to lessen or prevent the trapping of liquids between the lining layers. The upper 130 may comprise one or more ankle straps 131 configured to provide ankle support to a user and to secure the upper to the foot of the user. The ankle straps 131 may comprise hook and loop fasteners, for example, Velcro™ loops, cemented to a synthetic material. In one embodiment, the upper 130 comprises three ankle straps 131. In another embodiment, the upper 130 comprises two ankle straps 131. The upper 130 may also comprise foot straps 134 configured to provide support for a user's foot and to secure the article of footwear 100 to the foot of a user. The foot straps 134 may comprise nylon or another synthetic material and the straps 134 may include hook and loop fasteners, for example, Velcro™ portions, to fasten the straps 134 tightly around the foot of a user. In another embodiment, the article of footwear 100 may be secured to the foot of a user using laces.

Still referring to FIG. 1A, the upper 130 may also comprise a tongue 132. The tongue 132 can comprise synthetic materials, for example, water resistant, water proof, or water shedding materials. The tongue 132 may optionally comprise an injection molded foam pad, for example, ethylene vinyl acetate ("EVA"), preferably configured to increase or maximize fit and comfort for a user. The injection foam can be water resistant or water proof and may be designed to allow liquid to flow through the tongue 132 without being trapped. The injection foams can further be designed with a thick outer skin in order to prevent liquid from soaking the foot of a user, a problem common with traditional foam tongue designs. The upper 130 may also comprise foam padding disposed throughout the upper in order to provide support, comfort, and protection to a user's foot. The upper 130 may also comprise coupling loops 133 comprising nylon or another non-stretch durable material that can be stitched to the lateral sides of the upper 130. The coupling loops 133 can be stitched, or otherwise attached, onto the footwear 100 in order to create loops. The coupling loops 133 may be configured to allow the footwear 100 to be clipped or secured to a pack, a swimming fin, or any other item a user may wish to secure to the footwear. For example, the coupling loops 133 may be clipped to a back pack. Portions of the upper may include thicker and more rugged materials than other portions of the upper. For example, a lateral forefront guard 135 may be disposed near the sole 110 and may comprise material configured to protect a user's foot from blistering and/or to protect the upper from mechanical breakdown. For example, the lateral forefront guard 135 may comprise high abrasion rubber, leather, synthetic fabrics, rubber impregnated meshes or fabrics, and/or Kevlar™ reinforced materials with varying Kevlar™ contents. Different portions of the upper 130 may be stitched together using thread, for example, fire retardant stitching thread.

Still referring to FIG. 1A, the midsole 120 of the article of footwear 100 may be injection molded with EVA or a similar material to provide comfort and support to a user. Additionally, the use of injection foams instead of compression-molded foams provides a thicker outer or surface skin that is more water resistant. The outsole 111 may comprise thick rubber, or similar material, capable of protecting a user's foot from breach of the outsole. The outsole 111 may comprise solid rubber, injection rubber, and/or other moldable materials. In some embodiments, the outsole may be manufactured from anti-slip compounds to offer superior traction to a user. The outsole 111 may comprise contoured sidewalls configured to improve the article of footwear's agility when a user is climbing. Additionally, in some embodiments, the outsole 111 may comprise unique shapes, geometries, and materials to provide enhanced heel flexibility that can provide for reduced noise production during locomotion by lowering the amount of oscillation produced through the body. The following discussion and the appended figures disclose shapes, geometries, materials, and various other features that relate to a system that reduces the production of sound from footwear during locomotion.

Still referring to FIG. 1A, the upper 130 may also comprise a tongue 132. The tongue 132 can comprise synthetic materials, for example, water resistant, water proof, or water shedding materials. The tongue 132 may optionally comprise an injection molded foam pad, for example, ethylene vinyl acetate ("EVA"), preferably configured to increase or maximize fit and comfort for a user. The injection foam can be water resistant or water proof and may be designed to allow liquid to flow through the tongue 132 without being trapped. The injection foams can further be designed with a thick outer skin in order to prevent liquid from soaking the foot of a user, a problem common with traditional foam tongue designs. The upper 130 may also comprise foam padding disposed throughout the upper in order to provide support, comfort, and protection to a user's foot. The upper 130 may also comprise coupling loops 133 comprising nylon or another non-stretch durable material that can be stitched to the lateral sides of the upper 130. The coupling loops 133 can be stitched, or otherwise attached, onto the footwear 100 in order to create loops. The coupling loops 133 may be configured to allow the footwear 100 to be clipped or secured to a pack, a swimming fin, or any other item a user may wish to secure to the footwear. For example, the coupling loops 133 may be clipped to a back pack. Portions of the upper may include thicker and more rugged materials than other portions of the upper. For example, a lateral forefront guard 135 may be disposed near the sole 110 and may comprise material configured to protect a user's foot from blistering and/or to protect the upper from mechanical breakdown. For example, the lateral forefront guard 135 may comprise high abrasion rubber, leather, synthetic fabrics, rubber impregnated meshes or fabrics, and/or para-aramid synthetic fiber reinforced materials, such as Kevlar™ reinforced materials, with varying Kevlar™ contents. Different portions of the upper 130 may be stitched together using thread, for example, fire retardant stitching thread.

Figure 1B:
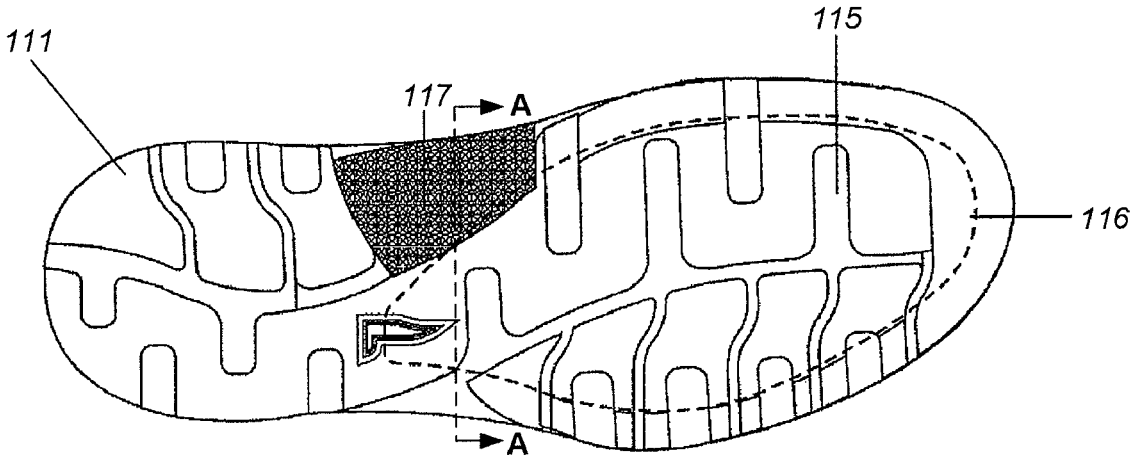
FIG. 1B schematically illustrates a bottom view of the article of footwear shown in FIG. 1A.

Turning now to FIG. 1B, a bottom view of the article of footwear shown in FIG. 1B is schematically depicted. The bottom of the outsole 111 includes anti-clogging lug shape contours 115 configured to provide grip for a user while preventing the collection of dirt on the bottom of the article of footwear 100. The contours 115 on the bottom of outsole 111 may be designed with larger radii and follow the unique shape of the bottom. The heel strike zone can be designed to flex during heel impact and follows the foot movement. These features allow for ultra smooth transition from heel to toe and thereby provide footwear that creates less noise during locomotion. These features can also enable a stabilized position for a user while the user is in motion by reducing body oscillation. The bottom of the outsole 111 also includes a climbing arch 117 and a protection plate 116. The protection plate 116 may extend from toe to heel, or may be located within the heel area only or forefoot section only. Multiple protection plates 116 may be included in the article of footwear 100 protecting different portions of the bottom of the article. The protection plate 116 may be embedded within the outsole or insole, or between the outsole and the insole and can be configured to prevent sharp object penetration of the sole. In some embodiments, the protection plate 116 comprises a material rigid enough and strong enough to stop a sharp object, for example, a nail sticking up from a piece of wood, from entering a user's foot when the user steps on the object. In some embodiments, the plate 116 is laminated or cemented between the injection molded EVA midsole 120 and outsole 111.

Still referring to FIG. 1B, the protective plate 116 may comprise a rigid material, for example, metal, fiberglass, composite, graphite, vinyl, thermoplastic urethane ("TPU") injected with long glass fiber, spring steel, or polycarbonate. The use of a protective plate 116 may decrease the amount of material required to form the outsole 111 and result in a lighter article of footwear than without the protective plate. In some embodiments, an article of footwear 100 weighs approximately 18 ounces. In other embodiments, an article of footwear 100 weighs between about 12 ounces and 24 ounces. In other embodiments, an article of footwear 100 weighs about 13 ounces. In other embodiments, an article of footwear 100 weighs about 14 ounces. In other embodiments, an article of footwear 100 weighs about 15 ounces. In other embodiments, an article of footwear 100 weighs about 16 ounces. In other embodiments, an article of footwear 100 weighs about 17 ounces. In other embodiments, an article of footwear 100 weighs about 18 ounces. In other embodiments, an article of footwear 100 weighs about 19 ounces. In other embodiments, an article of footwear 100 weighs about 20 ounces. In other embodiments, an article of footwear 100 weighs about 21 ounces. In other embodiments, an article of footwear 100 weighs about 22 ounces. In other embodiments, an article of footwear 100 weighs about 23 ounces. In other embodiments, an article of footwear 100 weighs about 24 ounces. In other embodiments, an article of footwear 100 weighs between about 8 ounces and 30 ounces.

Still referring to FIG. 1B, the article of footwear 100 has a pronounced last or heel-to-toe profile such that the sole 110 curves upward toward the toe box 140 from a point in the middle of the sole 110. A last is used as a mold to form the article of footwear 100 and the term "last" also refers to the shape of the article of footwear along a heel-to-toe profile. The shape of the last combined with the protective plate 116 partially transfer the downward momentum created by a user's step into forward momentum. In one embodiment, the last and protection plate 116 are sufficiently rigid to reduce forefoot flexion providing benefits including: the conversion of vertical compression forces into horizontal momentum; the reduction in the likelihood of injury to the user; less fatigue to the user; better body position alignment for the user; enhanced stability; and reduced impact to the user's skeletal system. In some embodiments, the last includes rotation shape geometries designed to reduce the fatigue experienced by a user. In some embodiments, the shape of the last is designed to contain a large amount of toe spring for a more natural forefoot transition through toe off. This shape may be achieved in conjunction with shape modifications to the molded rubber bottom and injection EVA midsole 120. The plate 116 can be manufactured by injection with glass fiber or other suitable composite materials.

Figure 2A:
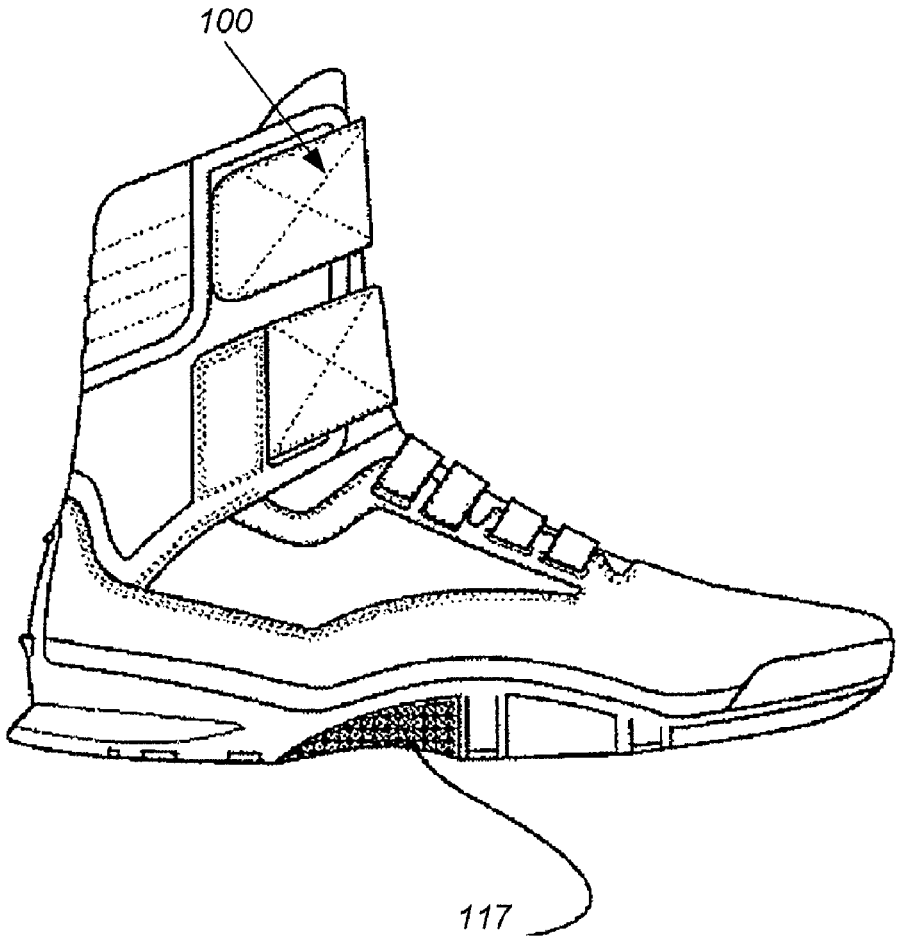
FIG. 2A schematically illustrates a right side view of the article of footwear shown in FIG. 1A.
Figure 2B:
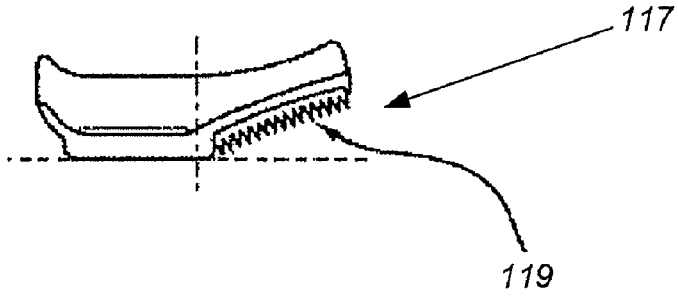
FIG. 2B schematically illustrates a cross-sectional view of the article of footwear shown in FIG. 1B taken along line A-A.

Turning now to FIG. 2A, a right side schematic view of the embodiment of FIG. 1A is depicted. The climbing arch 117 may be configured to prevent slippage between a climbing surface and the article of footwear 100 when a user is climbing. As shown in FIG. 2B, the climbing arch 117 includes an arch formed in the outsole 111 along with engagement members 119 configured to grip items in which a user has to climb. The climbing arch 117 may comprise a concave shell configured to receive a portion of a climbing surface. The climbing arch 117 may comprise rigid materials including fiberglass, fiberglass reinforced plastics, for example, TPU, nylons, Hytrel™, and other elastomers. In some embodiments, the engagement members 119 are made of the same materials as those found in the climbing arch 117. The engagement members 119 may be angularly designed to penetrate ropes and other surfaces that may be encountered when a user has to ascend an object. The engagement members 119 may also be designed to release from objects upon descent. The engagement members 119 may comprise groups of flexible teeth, for example, small plastic teeth. In one embodiment, an article of footwear includes a sole having a specialized ground or other object-engaging member, for example, a contoured climbing arch for enhanced traction during climbing.

Figure 2C:
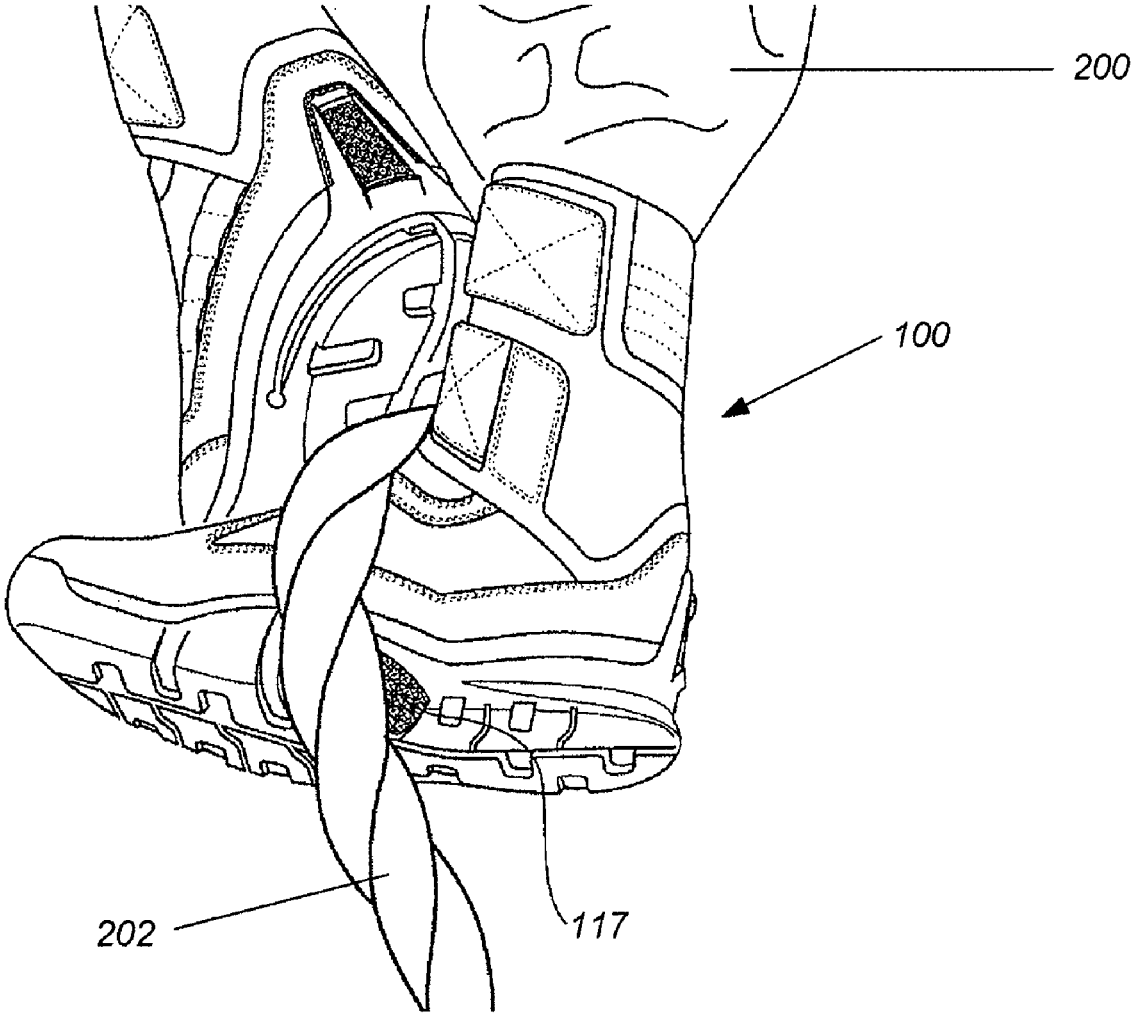
FIG. 2C schematically illustrates the multi-functional footwear shown in FIG. 1A, in use.

Turning now to FIG. 2C, multi-functional footwear 100 is shown being worn by a user 200 climbing a rope 202. A climbing arch 117 of one of the articles of footwear 100 is engaged with the rope 202 by engagement members configured to improve or maximize grip on the rope. The climbing arch 117 may decrease climbing times and therefore increase the safety of a user 200. In the illustrated embodiment, the climbing arch 117 is designed to receive rope and similarly contoured climbing surfaces. However, in other embodiments, a climbing arch 117 may be differently shaped to receive portions of differently shaped climbing surfaces. For example, in some embodiments, the climbing arch 117 may be shaped to receive portions of a tree. In some embodiments, the climbing arch 117 and engagement members 119 enable a user to finish a given climb in less time. The climbing arch could be comprised of carbon fiber, glassfiber reinforced nylon, TPU, or other injectable materials. It could also be comprised of steel or steel reinforced TPU, nylon, or other injectable materials.

Turning now to FIG. 2A, a right side schematic view of the embodiment of FIG. 1A is depicted. The climbing arch 117 may be configured to prevent slippage between a climbing surface and the article of footwear 100 when a user is climbing. As shown in FIG. 2B, the climbing arch 117 includes an arch formed in the outsole 111 along with engagement members 119 configured to grip items in which a user has to climb. The climbing arch 117 may comprise a concave shell configured to receive a portion of a climbing surface. The climbing arch 117 may comprise rigid materials including fiberglass, fiberglass reinforced plastics, for example, TPU, nylons, thermoplastic elastomers such as Hytrel™, and other elastomers:

In some embodiments, the engagement members 119 are made of the same materials as those found in the climbing arch 117. The engagement members 119 may be angularly designed to penetrate ropes and other surfaces that may be encountered when a user has to ascend an object. The engagement members 119 may also be designed to release from objects upon descent. The engagement members 119 may comprise groups of flexible teeth, for example, small plastic teeth. In one embodiment, an article of footwear includes a sole having a specialized ground or other object-engaging member, for example, a contoured climbing arch for enhanced traction during climbing.

Figure 3A:
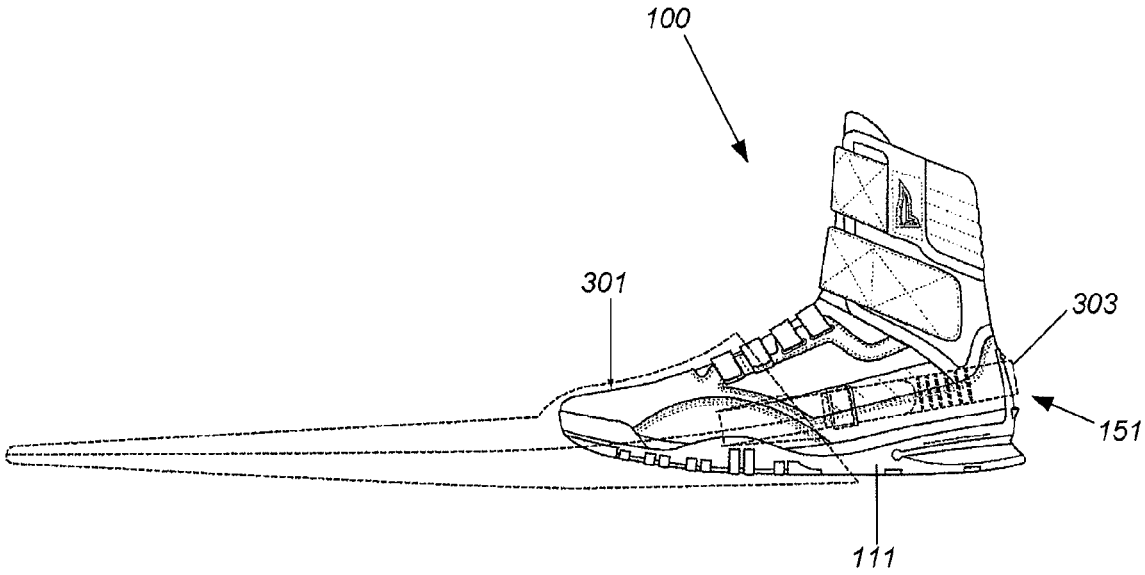
FIG. 3A schematically illustrates the article of footwear shown in FIG. 1A coupled with a swimming fin.
Figure 3B:
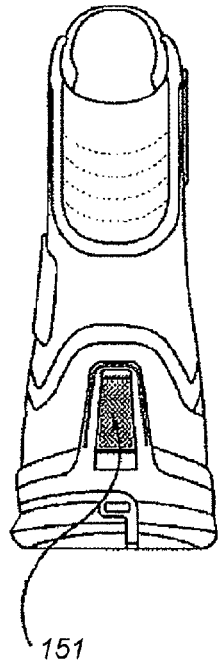
FIG. 3B schematically illustrates a rear view of the article of footwear shown in FIG. 1A.

Turning now to FIG. 3A, the article of footwear depicted in FIG. 1A is depicted received by a swimming fin 301. The outsole 111 of the article of footwear 100 has contoured side walls configured to allow the outsole 111 to fit into standard swimming fins allowing a user to secure a swimming fin to their foot while still wearing the article of footwear 100. In some embodiments, the contoured sidewalls reduce on and off time for a user to put on swimming fins. As shown in FIGS. 3A and 3B a securing portion 151 may be located on the heel portion of the article of footwear 100. The securing portion 151 may be configured to receive a portion of a swimming fin strap 303 and secure the strap 303 to the heel portion 150 in order to prevent decoupling of the swimming fin 301 from the article of footwear 100. The securing portion 151 may include raised ledges designed to lock and prevent fin strap slippage allowing a user to have increased power during swimming locomotion. The securing portion 151 may comprise rubber, abrasive plastics, hardened rubber, TPU, nylons, and similar materials. In one embodiment, the securing portion 151 comprises rubber.

Figure 3C:
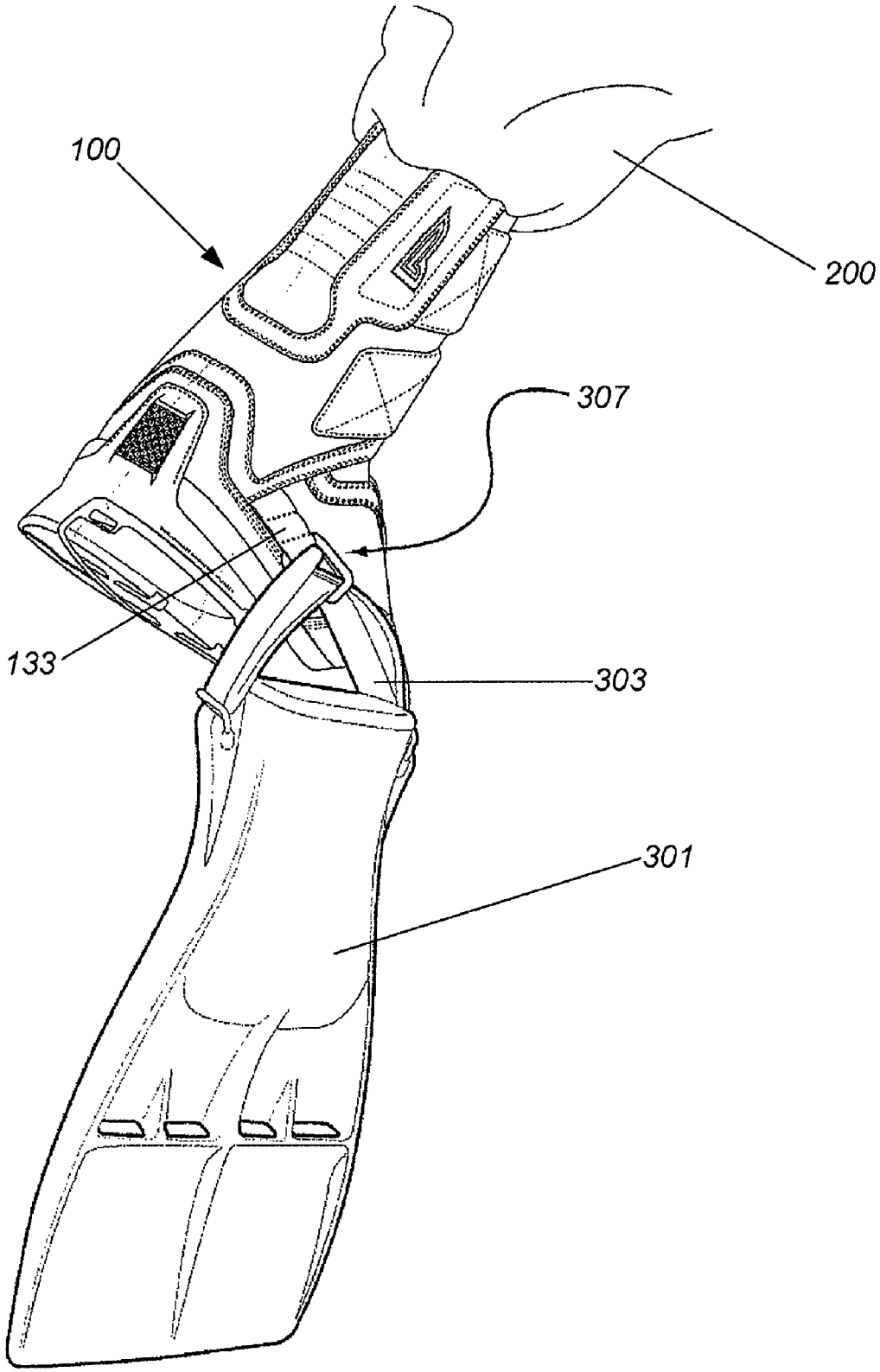
FIG. 3C schematically illustrates the footwear shown in FIG. 3A, in use.

Turning now to FIG. 3C, an article of footwear 100 is shown coupled to a swimming fin 301. The article of footwear 100 includes coupling loops 133 formed in the upper 130 configured to allow the article of footwear to be clipped or joined to another object. In the illustrated embodiment, the strap 303 of the swimming fin 301 is fastened to a coupling loop 133 by a clip 307. The coupling loops 133 may comprise Nylon or other non-stretch material. The coupling loop 133 may be used to provide a secure safety latching system to ensure the continued attachment of swimming fins during jumps, swimming, storage, or other situations in which a user may possibly lose their fins. In other embodiments, the coupling loops 133 may be configured to clip the footwear 100 to a pack, to swim fins, or to any other items a wearer may wish to secure to the footwear.

Figure 4A:
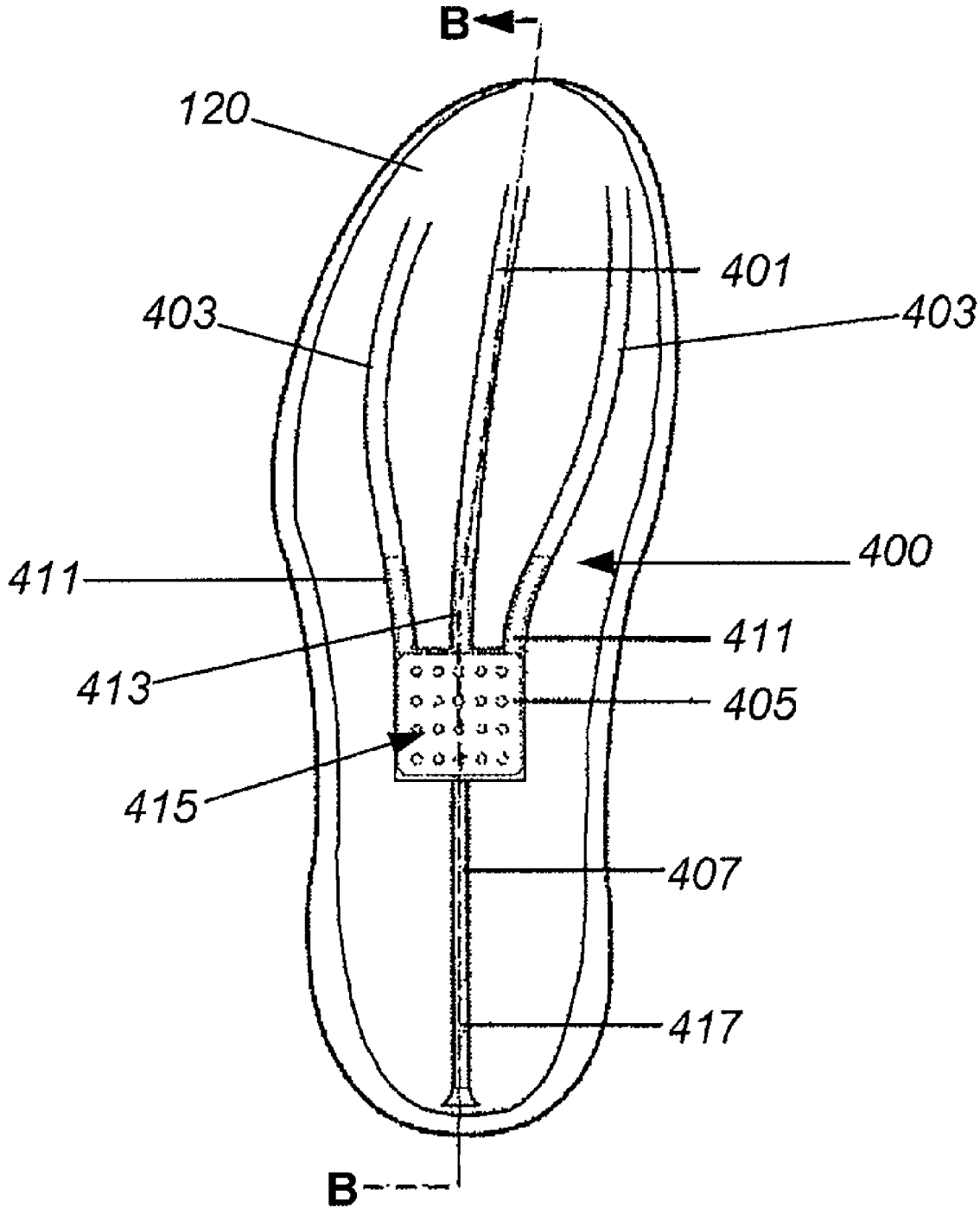
FIG. 4A schematically illustrates a top view of the midsole of the article of footwear shown in FIG. 1A.

Turning now to FIG. 4A, the top of a midsole 120 is schematically depicted including a drainage system 400 embedded in the midsole. The drainage system 400 allows for the rapid discharge of liquid trapped in the upper by the use of channels designed to direct the trapped liquid to the lateral portions of the insole via the expulsion of liquid out a one-way valve. The drainage system 400 is particularly suited for use with footwear fluid systems and other types of athletic equipment. The drainage system 400 may comprise flexible plastics and rubbers, for example, TPU, TPR, and PVC. As discussed above, the last provides toe spring through the curve from the middle of the sole 110 to the toe box 140. The shape of the last is a key element that enables liquid trapped in the footwear to be expelled out of the drainage system 400. The drainage system 400 includes a midsole channel 401, a midsole duct 413, forefoot channels 403, forefoot ducts 411, a mid-foot bladder 405, and a rear duct 407. Water is shed from the article of footwear through materials and unique design. In one embodiment, the upper can be created using all nanotech materials that decrease absorption of liquids. The construction of the upper can include a significant reduction in the needs for adhesives which will limit the ability of liquids to become trapped between layers. Accordingly, trapped liquids will collect in the midsole region 120, where they will be subject to expulsion from the footwear via a drainage system, thereby resulting in accelerated drying times and limited weight gains after the footwear is submerged in liquid. The mid-foot bladder 405 is configured to collect accumulated liquid and drain the liquid out of the rear of the footwear during locomotion. The mid-foot bladder 405 includes apertures 415 to receive liquid that collects in the midsole 120. The midsole 120 includes a midsole channel 401 that is configured to draw liquid that accumulates within the footwear into the mid-foot bladder via a midsole duct 411. Similarly, forefoot channels 403 may draw liquid that accumulates within the footwear into the mid-foot bladder 405 via forefoot ducts 411. Through gravity and motion, any liquid received by the mid-foot bladder 405 is forced out the rear heel section of the footwear via the rear duct 407. The rear duct 407 may comprise a one-way valve system 417 that only allows liquid to travel out of the article of footwear. In some embodiments, the footwear includes a sockliner (not shown) created using injection molding, for example, injection EVA. The thicker skin of the injection moldings will prevent liquid from being soaked up by the moldings and the sockliner can be designed with perforations to allow liquids to run through and into the mid-foot bladder 405.

Figure 4B:
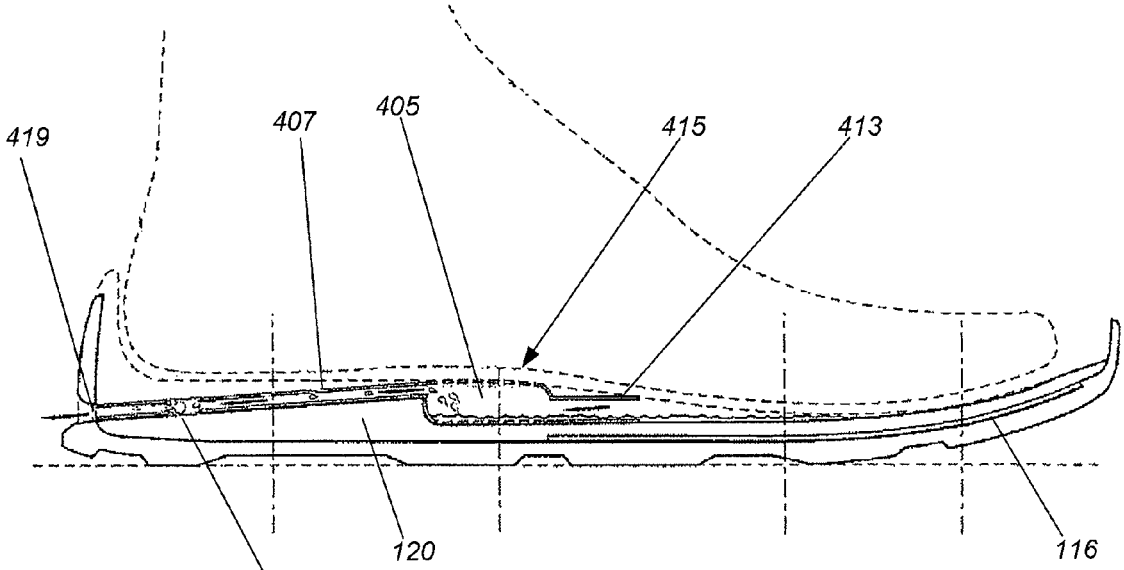
FIG. 4B schematically illustrates a cross-sectional view of the article of footwear shown in FIG. 4A taken along line B-B.
Figure 4C:
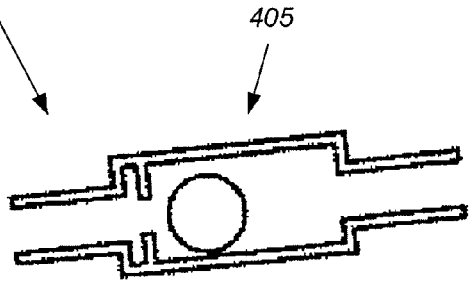
FIG. 4C schematically illustrates an enlarged view of a portion of the article of footwear shown in FIG. 4B.
Figure 4D:
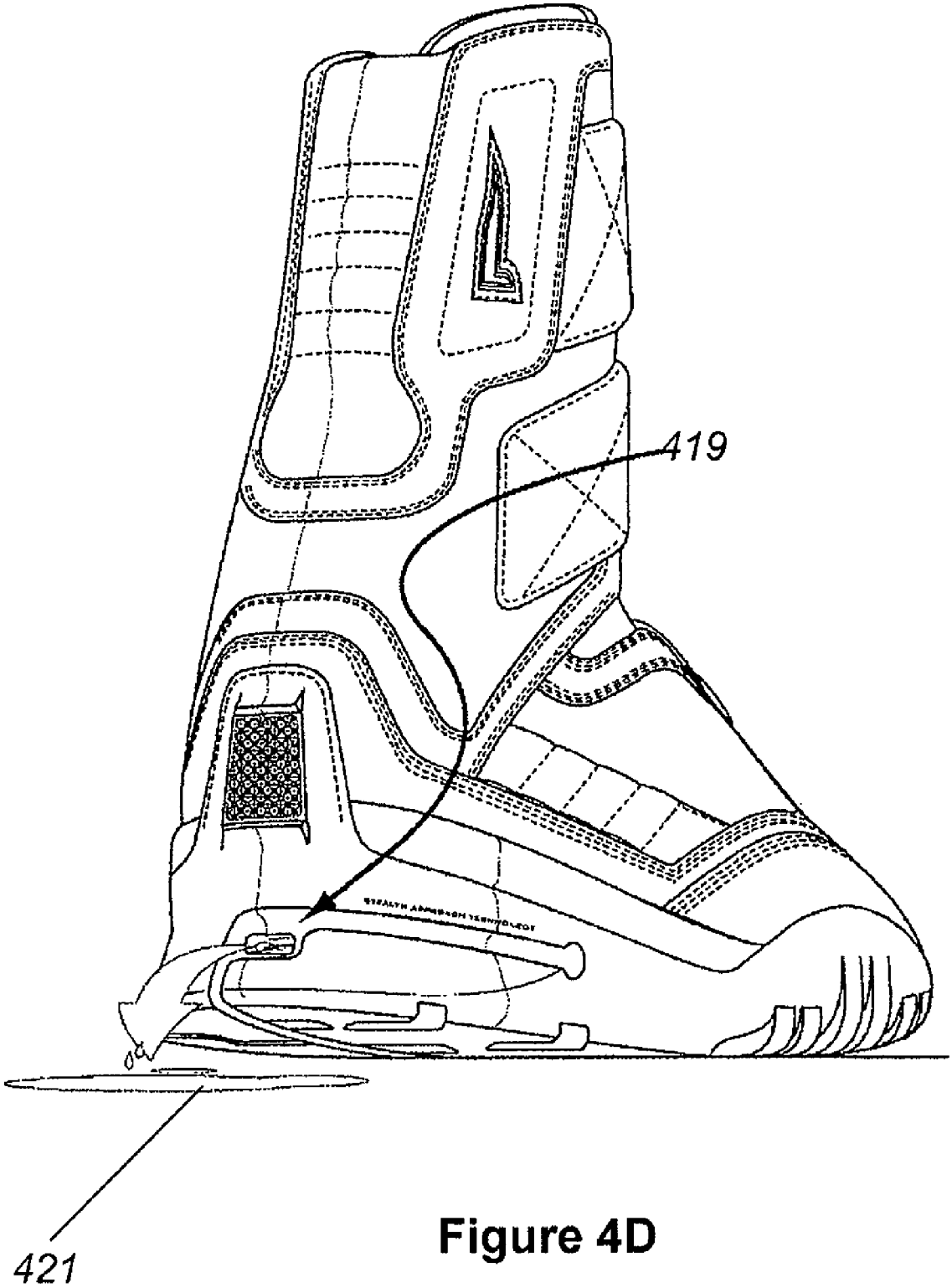
FIG. 4D schematically illustrates a rear perspective view of the article of footwear shown in FIG. 1A.

Referring now to FIG. 4B, the mid-foot bladder 405 may be created by high frequency welding TPU sheets or similar methods. In one embodiment, a TPU sheet faces the foot and includes small apertures to allow the penetration of liquids. The shape of the mid-foot bladder 405 may be curved and rise above the surface of the midsole 120 so that during locomotion the foot can press down onto the bladder. During this pressure phase, the footbed of the user will seal the holes 415 on the top of the bladder and expel any liquid through the rear duct 407 attached to the bladder out an expulsion opening 419. As shown in FIG. 4C, the rear duct 407 includes a one-way valve system 407 that only allows liquid to travel out of the shoe but does not allow ingress of liquid. As depicted in FIG. 4D, the drainage system 400 is configured to expel liquid 421 that accumulates within the article of footwear during locomotion while preserving the mechanical stability required for rugged footwear.

The foregoing description details certain embodiments. It will be appreciated, however, that no matter how detailed the foregoing appears in text, the described embodiments may be practiced in many other ways. As is also stated above, it should be noted that the use of particular terminology when describing certain features or aspects should not be taken to imply that the terminology is being re-defined herein to be restricted to including any specific characteristics of the features or aspects with which that terminology is associated.

What is claimed is:

1. An article of footwear comprising a sole and an upper secured to the sole, the article of footwear comprising a toe area and a heel area, the upper comprising a distal surface and a proximal surface, the sole comprising:

a midsole secured to the upper, the midsole having a first surface and a second surface, the first surface being disposed between the upper and the second surface;

an outsole coupled with the second surface, the outsole having a bottom surface and a top surface, the top surface being disposed between the upper and the bottom surface, the outsole comprising a climbing arch disposed at least partially on the bottom surface, the climbing arch being configured to receive at least a portion of a climbing surface and a plurality of engagement members extending outwardly from the climbing arch in a distal direction, the engagement members being configured to engage a climbing surface;

a protective plate disposed at least partially between the upper and the bottom surface, the protective plate comprising a material that is harder than the midsole and the outsole;

a plurality of outwardly extending protrusions extending from the upper, at least one protrusion extending from the heel area, the plurality of outwardly extending protrusions forming a receiving area configured to receive at least a portion of a second body; and a drainage system disposed at least partially between the first surface and the bottom surface, the drainage system being configured to drain liquid from within the article of footwear.

2. The article of footwear of claim 1, wherein the engagement members comprise a different material than the climbing arch.

3. The article of footwear of claim 1, wherein the engagement members comprise flexible teeth.

4. The article of footwear of claim 1, wherein the upper comprises a first portion and a second portion, the first portion being disposed at least partially on at least one lateral side of the article of footwear and comprising a material that is more resistant to friction than the second portion.

5. The article of footwear of claim 4, wherein the first portion and second portion are coupled together with flame retardant thread.

6. The article of footwear of claim 4, wherein the first portion comprises a para-aramid fiber reinforced material.

7. The article of footwear of claim 4, wherein the first portion comprises one or more insulation layers.

8. The article of footwear of claim 1, wherein the upper comprises one or more loops disposed on the distal surface, said loops being configured to couple the upper with the second body.

9. The article of footwear of claim 8, wherein the one or more loops are disposed at least partially on at least one lateral side of the article of footwear.

10. The article of footwear of claim 8, wherein the one or more loops comprise nylon.

11. The article of footwear of claim 1, wherein the drainage system comprises:

a channel configured to draw liquid that accumulates between the upper and the bottom surface towards a distal surface of the outsole;

a bladder connected to the channel and configured to receive the liquid drawn by the channel, the bladder comprising a flexible material and at least one aperture, the at least one aperture configured to receive liquid that accumulates between the upper and the bottom surface; and an exit duct connected to the bladder, the exit duct configured to receive liquid expelled by the bladder and direct it away from the outsole, the exit duct comprising a one-way valve that is configured to allow the egress of liquid from the bladder of footwear but does not allow liquid to enter the bladder of footwear.

12. An article of footwear comprising a sole and an upper secured to the sole, the upper comprising a distal surface and a proximal surface, the sole comprising:

a top surface;

a bottom surface disposed such that the top surface is between at least a portion of the upper and the bottom surface;

a protective plate disposed at least partially between the top surface and the bottom surface; and a drainage system disposed at least partially between the top surface and the bottom surface, the drainage system being configured to drain liquid from within the article of footwear, said drainage system comprising, a channel configured to draw liquid that accumulates between the upper and the bottom surface towards a distal surface of the article of footwear, a bladder connected to the channel and configured to receive liquid drawn by the channel, the bladder comprising flexible material defining an interior space and at least one aperture in communication with said interior space, the at least one aperture configured to receive liquid that accumulates between the bladder and the upper, and an exit duct connected to the bladder for directing the liquid out of the bladder.

13. The article of footwear of claim 12, wherein the drainage system wherein the exit duct is configured to receive liquid expelled from the interior space of the bladder and direct it away from the article of footwear, the exit duct comprising a one-way valve that is configured to allow the egress of liquid from the bladder but does not allow liquid to enter the bladder.

14. The article of footwear of claim 13, wherein the drainage system comprises TPU.

15. An article of footwear comprising a sole and an upper secured to the sole, the sole including a side surface and a bottom surface, the upper comprising a distal surface and a proximal surface, the sole comprising:

a protective plate configured to protect the foot of a user, the protective plate disposed at least partially between the bottom surface and the upper; and a climbing arch extending from the side surface to the bottom surface of the sole, the climbing arch being configured to receive at least a portion of a climbing surface and comprising a plurality of teeth extending from the climbing arch, the teeth each configured with a point for engaging a climbing surface.

16. The article of footwear of claim 15, wherein the protective plate comprises a material selected from the group consisting of metal, fiberglass, composite materials, TPU injected with long glass fiber, spring steel, or polycarbonate, and mixtures thereof.

17. The article of footwear of claim 15, wherein the climbing arch comprises a material selected from the group consisting of fiberglass, fiberglass reinforced plastics, TPU, nylon, thermoplastic elastomers, and mixtures thereof.

18. An article of footwear comprising:

a midsole;

an outsole attached to the midsole, the outsole having a bottom surface and a top surface, and including a climbing arch disposed at least partially on the bottom surface, the climbing arch including at least one engagement member extending outwardly from the climbing arch in a distal direction and configured to engage a climbing surface;

a protective plate disposed at least partially between the upper and the bottom surface, the protective plate comprising a material that is harder than the midsole and the outsole;

at least one protrusion extending outwardly from the upper and forming a receiving area configured to receive at least a portion of a second body; and a drainage system disposed at least partially between the first surface and the bottom surface, the drainage system being configured to drain liquid from within the article of footwear.

19. The article of footwear of claim 18, further comprising a securing portion including opposing raised ledges and a space defined between said ledges for receiving a strap of a swim fin, wherein said ledges limit vertical movement of the strap.

20. An article of footwear comprising:

an upper including at least one coupling loop and a clip secured to said coupling loop;

an outsole coupled to the upper, said upper and said outsole combining to form a toe area and a heel area, said toe area being shaped to engage a swim fin; and a securing portion on said heel area and including opposing raised ledges and a space defined between said ledges for receiving a strap of the swim fin, wherein said ledges limit vertical movement of the strap.

21. An article of footwear comprising a sole and an upper secured to the sole, the sole including a side surface and a bottom surface, the upper comprising a distal surface and a proximal surface, the sole comprising:

a climbing arch extending from the side surface to the bottom surface of the sole, the climbing arch being configured to receive at least a portion of a climbing surface and comprising a plurality of teeth extending from the climbing arch, the teeth each configured with a point for engaging a climbing surface.

22. The article of footwear of claim 21, wherein said climbing arch extends at an angle from the side surface to the bottom surface of the sole.

* * * * *

UNITED STATES PATENT AND TRADEMARK OFFICE

CERTIFICATE OF CORRECTION

PATENT NO. : 8,296,973 B2
APPLICATION NO. : 12/404928
DATED : October 30, 2012
INVENTOR(S) : Roberti It is certified that error appears in the above-identified patent and that said Letters Patent is hereby corrected as shown below:

In the Specification:

In Column 6, Line 6, of the issued patent, insert --para-aramid synthetic fiber reinforced materials, such as-- after "fabrics, and/or" and before "Kevlar™"

In Col 6, Line 6, of the issued patent, insert --,-- (comma) after "Kevlar™ reinforced materials"

In Col 8, Line 25, of the issued patent, insert --thermoplastic elastomers such as-- after "TPU, nylons," and before "Hytrel™"

In Col 6, Lines 32-67, of the issued patent, make the following corrections:

Delete the paragraph starting on Line 32 beginning with "Still referring to Fig. 1A, the upper" and ending on Line 67 finishing with "for example, fire retardant stitching thread." In its place, insert "Still referring to Figure 1A, a toe box 140 is located at the front of the article of footwear 100 and is configured to receive and protect the toes of a user. The toe box 140 may comprise portions of the outsole 111, midsole 120, and upper 130. In one embodiment, the front portion of the outsole 111 is machine ground to provide traction for climbing and added durability. The material of the upper 130 covering the toe box 140 may be chosen to mitigate thermal and electric fluxes. In one embodiment, the portion of the upper 130 covering the toe box 140 comprises rubber. A heel portion 150 is located at the back of the article of footwear 150. The heel portion 150

Signed and Sealed this
Sixth Day of August, 2013

Teresa Stanek Rea
*Acting Director of the United States Patent and Trademark Office*

In the Specification:

may be configured to provide support and protection for the heel of a user's foot. The heel portion 150 may be sculpted to reduce drag when a user is wearing a swimming fin over the article of footwear 100. The heel portion 150 may also include a securing portion 151 configured to receive a strap, for example, a swimming fin strap, and secure the received strap to the heel portion 150. The securing portion 151 may extend from the outsole 111, the upper 130, or both." Insert this after "the production of sound from footwear during locomotion." Insert this before "Turning now to Fig. 1B,"

Figure 2D:
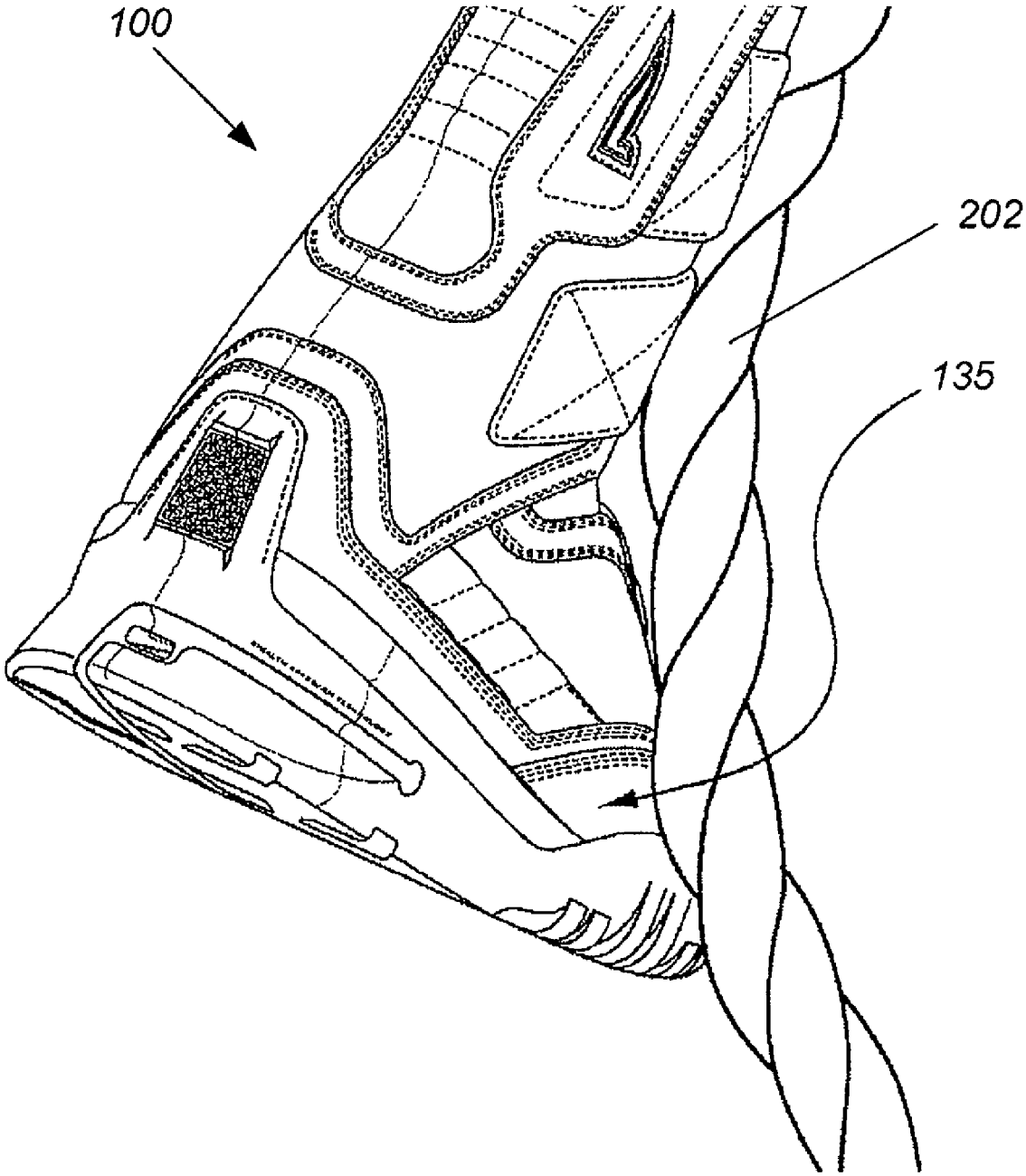
FIG. 2D schematically illustrates the multi-functional footwear shown in FIG. 1A, in use.

In Columns 8-9, Lines 56-12, of the issued patent, make the following corrections:

Delete the paragraph starting on Page 8, Line 56 beginning with "Turning now to Fig. 2A a right side schematic view" and ending Page 9, Line 12 finishing with "a contoured climbing arch for enhanced traction during climbing." In its place insert "Turning now to Figure 2D, the lateral forefront guard 135 of the article of footwear depicted in Figure 1A is in contact with a rope 202. As mentioned above, a lateral forefront guard 135 of the upper 130 may comprise material configured to protect a user's foot from blistering and/or protect the upper 130 from mechanical breakdown. In some embodiments, the forefront guard 135 comprises thick material. In some embodiments, the lateral forefront guard 135 of the upper may comprise a ware-resistant and friction-resistant material that is configured to protect a user's foot from abrasion and frictional forces during rope, rappelling, and related operations. In some embodiments, the lateral forefront guard 135 has at least substantially the same shape as the typical surface of the footwear. For example, in one embodiment, the lateral forefront guard 135 comprises Kevlar™ configured to minimize the heat and friction produced by the contact between an article of footwear and a rope during rope training including rope descents. In other embodiments, the lateral forefront guard 135 comprises Kevlar™ reinforced material, high abrasion rubber, or rubber impregnated materials. In some embodiments, the lateral forefront guard 135 is optionally lined with an insulation layer or layers in order to further protect a user's foot from heat created by frictional forces. During high speed repelling, heat and friction produced between footwear and a rope will result in "burning" through the upper, sometimes even doing direct damage to a user's foot. A lateral forefront guard 135 alleviates such injury and comfort problems. In some embodiments, the material chose for the forefront guard 135 may be water resistant or water proof." Insert this after "TPU, nylon, or other injectable materials." Insert this before "Turning now to Fig. 3A,"